US006786732B2

(12) United States Patent
Savill et al.

(10) Patent No.: US 6,786,732 B2
(45) Date of Patent: Sep. 7, 2004

(54) TOOTHBRUSH USAGE MONITORING SYSTEM

(75) Inventors: Derek Guy Savill, Bebington (GB); Robert Lindsay Treloar, Bebington (GB)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 10/117,680

(22) Filed: Apr. 5, 2002

(65) Prior Publication Data

US 2002/0183959 A1 Dec. 5, 2002

(30) Foreign Application Priority Data

Apr. 17, 2001 (EP) ..... 0109444

(51) Int. Cl.[7] ..... G09B 23/28
(52) U.S. Cl. ..... 434/263
(58) Field of Search ..... 434/263; 433/215, 433/216, 68, 69; 132/308, 311; 601/141; 15/105, 22.1

(56) References Cited

U.S. PATENT DOCUMENTS

| | | | | | |
|---|---|---|---|---|---|
| 4,435,163 | A | * | 3/1984 | Schmitt et al. | 434/263 X |
| 4,476,604 | A | * | 10/1984 | White et al. | 15/105 X |
| 4,716,614 | A | * | 1/1988 | Jones et al. | 15/105 X |
| 4,765,345 | A | * | 8/1988 | Adib | 600/590 X |
| 4,837,685 | A | * | 6/1989 | Jokela | 600/590 X |
| 4,837,732 | A | * | 6/1989 | Brandestini et al. | 433/29 X |
| 5,278,756 | A | * | 1/1994 | Lemchen et al. | 600/587 X |
| 5,561,881 | A | | 10/1996 | Klinger et al. | |
| 5,784,742 | A | * | 7/1998 | Giuliani et al. | 15/22.1 X |
| 5,842,858 | A | * | 12/1998 | Truppe | 433/69 X |
| 5,876,207 | A | * | 3/1999 | Sundius et al. | 433/216 X |
| 5,989,023 | A | * | 11/1999 | Summer et al. | 433/69 X |
| 6,389,633 | B1 | | 5/2002 | Rosen | |
| 6,536,068 | B1 | * | 3/2003 | Yang et al. | 15/105 X |
| 2003/0131427 | A1 | * | 7/2003 | Hilscher et al. | 15/22.1 X |

FOREIGN PATENT DOCUMENTS

| | | |
|---|---|---|
| DE | 37 16490 | 5/1987 |
| DE | 195 06 129 | 2/1995 |
| DE | 100 01 502 | 1/2000 |
| EP | 0 869 745 | 10/1995 |
| WO | 02/096261 | 12/2002 |

* cited by examiner

*Primary Examiner*—Jessica Harrison
*Assistant Examiner*—Chanda L. Harris
(74) *Attorney, Agent, or Firm*—Milton L. Honig

(57) ABSTRACT

A method is proposed for analysing the usage of a toothbrush made by a subject. The position of the toothbrush is monitored using a position sensor on the brush, and the position of the teeth is monitored by a position sensor mounted in a known fixed relation to the teeth. The resultant data is used to find the relative positions of the toothbrush and teeth over time. Statistical analysis of this data permits the identification of habitual brushing failures by subjects of the toothbrush. The toothbrush may transmit the output of its position sensor to a data analysis unit as a wireless signal. The toothbrush may also be provided with further sensors, such as pH and pressure sensors, the output of which is used in the statistical analysis to enrich the results.

13 Claims, 4 Drawing Sheets

TOOTHBRUSH USAGE MONITORING SYSTEM

BACKGROUND OF THE INVENTION

1. Field of the Invention

The present invention relates to methods and apparatus for monitoring the usage of a toothbrush by an individual, and for analysing the data thus obtained to identify incorrect usage.

2. The Related Art

It is well known that many dental problems experienced by individuals who regularly use a toothbrush are associated with poor usage of the toothbrush. For example, even if the toothbrush is used several times each day, due to incorrect brushing habits the brush may always fail to come into contact with certain areas of the teeth. Poor brushing coverage of the teeth may also be caused, or at least exacerbated by the design of the toothbrush.

SUMMARY OF THE INVENTION

The present invention aims to provide new and useful methods and apparatus for monitoring usage of a toothbrush.

In general terms, a first aspect of the invention proposes that the position of a toothbrush should be monitored relative to the position of the teeth of an individual (i.e. a human subject). The toothbrush contains a first position sensor, and the output of the sensor is fed to processing apparatus which also receives data output from a second position sensor mounted in fixed relationship to the teeth. The processing apparatus compares the two sensor outputs to monitor the position of the toothbrush relative to the teeth over a period of time. Preferably two second position sensors are provided, each in a fixed relationship to the teeth of a respective one of the subject's jaws. Preferably, the position of the toothbrush with respect to the subject's teeth is displayed visually, for example as an image on a screen showing the teeth and the toothbrush in their respective positions, or as an image of the teeth with the track of a point of the toothbrush marked as a path over them. The display may be generated in real time, or subsequently.

Preferably the output of the processing apparatus determines the position of the teeth relative to the toothbrush to a high precision, for example to within a few millimetres. To make this possible, the position of the second position sensor relative to the teeth must be registered. Accordingly, in a second aspect, the invention provides a method of determining the position of teeth relative a position-sensitive probe mounted in fixed relationship to the teeth (e.g. on a location of the jaw). The second aspect of the invention proposes that a third position sensor is located in turn during a period of time on, or more generally in a known positional relationship to, the second position sensor(s) and at least four locations on the teeth (preferably more than 4, e.g. up to 200), the output of the third position sensor being monitored during this time.

The at least four locations may either have a known fixed relationship to the teeth (such as four locations which actually are known to be specific points on the teeth), or they may be locations which are determined by the registration process as described below.

Preferably the locations should be evenly spread over the feature to be tracked covering the extents of the feature.

Note that in some embodiments the third position sensor may in fact be the same position sensor which is used in the first embodiment of the invention, i.e. the first position sensor.

The output of the second and third position sensors over this period (even though both will normally only be registering changes in their absolute position, not position relative to each other) are sufficient to determine the position of the second position sensor relative to the teeth.

In a third aspect of the invention, once data is available, preferably from a method according to the first and second aspects of the invention, indicating over a period of time the variation of the position of the toothbrush relative to the teeth, this data is analysed statistically to determine whether it contains any pattern of usage indicative of poor habitual usage. For example, the invention may include determining for each area of the teeth the frequency with which it contacts the toothbrush and comparing this data to pre-existing information characterising correct usage (e.g. a minimum correct frequency of contact. This may be a single value which applies to all surfaces of all the teeth, or a value which varies with different surfaces and/or with different teeth). Another possible analysis is of the orientation of the toothbrush with time during the tooth-brushing event. In either case, if a discrepancy is noted between correct usage and the observed usage, a warning signal is emitted, or, in embodiments discussed below in which the brushing event is being displayed visually, the colour within the display of any tooth or teeth not being visited could be changed or those teeth made to flash.

Although position information on its own is potentially very useful as described above, the information is yet more useful in combination with other sources of information about toothbrush usage. For this reason, a fourth aspect of the invention proposes that a toothbrush should carry other sensors which are sensitive to factors other than position, such as pressure sensors, pH sensors, etc.

A toothbrush as proposed in the first and fourth aspects of the invention generally requires a means of transmitting its data (e.g. to the processing apparatus). While this can be done within the scope of the invention by an electronic or optical fibre, a sixth aspect of the invention proposes that a toothbrush carries wireless data transmission means, such as a transmitter of electromagnetic (preferably radio) waves. Acoustic waves might also be suitable for this purpose, though they should preferably be at a frequency which is inaudible to individuals. The processing apparatus is provided with a corresponding wireless signal reception device. Similarly, the position sensors (especially the first position sensor) are preferably self-powering devices, meaning that they generate all power required for their operation from their motions due to motions of the subject.

Although the invention has mainly been described above in relation to methods, all features of it may alternatively be expressed in terms of a corresponding apparatus arranged to facilitate the invention. Furthermore, the analysis performed in the methods of the apparatus may be performed by computer software present in a computer program product which is readable by a computer apparatus to cause the computer apparatus to perform the processing.

The term "relative position" of two objects, is used in this document to include the translational distance and spacing direction of two objects (a total of 3 degrees of freedom). However, any measurement of the position referred to herein is preferably accompanied by a logically separate measurement of the relative orientation of the two objects (a further 3 degrees of freedom). For example, the measurement of the "position" of a toothbrush relative to teeth, i.e. measurement of the three-dimensional location of a notional centre of the toothbrush in reference frame defined by the teeth, is accompanied by a measurement of the angle of orientation of the toothbrush around that centre. Thus, while the position of the toothbrush relative to the teeth shows whether the toothbrush is close to a given tooth, and in what direction it is spaced from the tooth, the orientation of the toothbrush represents which direction any given face of the toothbrush (e.g. the upper surface of the bristle head of the toothbrush) faces in the reference frame of the teeth.

Similarly, each "position sensor" used in this document preferably is not only operative to measure changes in its absolute position, but preferably is also operative to measure changes in its orientation. A variety of sensors are known for this task, such as Minibird sensor sold by Ascension Technology Corporation, P.O. Box 527, Burlington, Vt. 05402, USA, which is only some 5 mm in diameter.

A sensor is said to be in fixed positional relationship to either the upper or lower set of teeth when its position and orientation is fixed in relation to those teeth.

There also exist types of sensors that are sensitive only to their position in space, they do not have an intrinsic orientation which can be reported. Such three degree of freedom sensors my also be used in an alternative embodiment of the invention, since the output from combinations of three such sensors the feature to be tracked can be used to calculate missing orientational information. The sensors must be placed accurately at the known offset to one another. The optimum offset will depend on the geometry of the object being tracked.

BRIEF DESCRIPTION OF THE DRAWING

The various aspects of the invention discussed above, and their preferred features, are freely combinable, as will be evident from the following non-limiting description of an embodiment of the present invention.

DETAILED DESCRIPTION OF THE INVENTION

Figure 1:
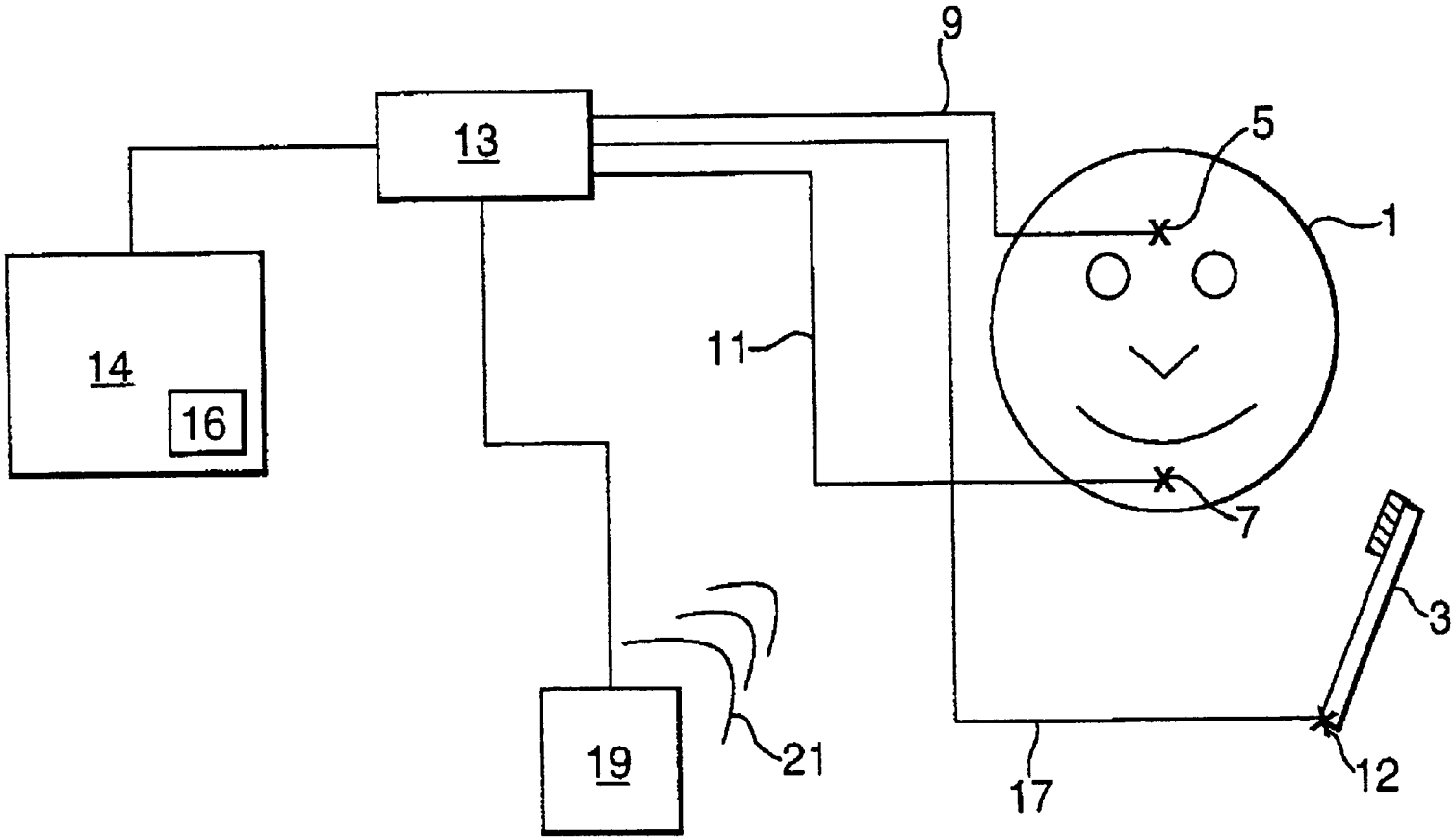
FIG. 1 shows a system according to an embodiment of the present invention in use.

FIG. 1 shows an embodiment of the invention applied to a subject 1 who operates a toothbrush 3. Two position sensors 5, 7 are mounted on the head of the subject in fixed relationship to the teeth of the subject's upper and lower jaws respectively. The mounting may for example be by a soluble adhesive, or using a section of gummed tape. The selection of the location on the subject's head determines how reliably the position sensors 5, 7 registers the position of the subject's teeth.

The output of the position sensors 5, 7 in this embodiment is transmitted electronically via respective wires 9, 11 to an interface unit 13 which transforms this data into a format suitable for input to a computing apparatus 14, such as a PC, having a screen 16 for displaying the results of the method.

The sensor 7 is rigidly attached to the subject's head so the sensor can be placed in principle anywhere on the upper head, though best resolution will be obtained by having it fixed as close to the upper jaw as possible. We have found the bridge of the nose to be a good region. The sensor 5 is attached typically at the centre of the chin.

The positioning both of these jaw sensors is a trade off between:

(a) A need to attach the sensors as robustly as possible (b) A need to attach the sensors as near to the jaws as possible (c) A need to be as non-invasive as possible.

Both of these sensors 5, 7 are simply attached using medical tape. Note that because of the registration procedure we apply, which is described subsequently, it is not a requirement that the sensors always be attached in exactly the same place on each subject, or be attached to any particular visual landmark on the face, beyond the broad restrictions given by (a), (b) and (c).

The system further includes a position sensor 12 mounted on the toothbrush 3. Ideally it should be attached as near the end of the handle as possible to be minimally invasive. Again it is not a requirement that it be attached at the same place on each toothbrush for each subject. The toothbrush 3 includes a data transmission device for transmitting data output by the position sensor 12 to the interface unit 13 using a wire 17.

The system further includes a transmitter unit 19 which generates a known DC magnetic field shown generally as 21. The position sensors 5, 7, 14 determine their respective orientations and positions by reference to this magnetic field.

The sensors 5, 7, 14 are selected to capture faithfully motions of the upper and lower jaws and toothbrush with good resolution over the whole period of the tooth brushing event.

These sensors need to be small (e.g. up to 10 mm in maximum diameter), capable of outputting their position and orientation at a rapid enough rate to track the tooth brushing event at sufficient resolution over the whole period of brushing, and as minimally invasive as possible so as to minimise the interference with the tooth brushing process.

Additionally, a fourth sensor 25 (shown in FIG. 2) which is part of a probe is used in the registration process and is described below.

The position sensors we have chosen to use are Minibird sensors. A Minibird sensor determines its position and orientation by sensing a DC magnetic field, in this case the one generated by the transmitter unit 19.

The Minibird sensor has been chosen because it is the smallest available with sufficient resolution and capture rate and originally designed for use in surgical environments. However, any sensor, tethered or remote, could be used if it has the required resolution and capture rate and is sufficiently non-invasive.

The position and orientation information that each sensor 5, 7, 14 returns will be collectively referred to as the sensor's state. This state information is returned relative to a set of Cartesian co-ordinate axes systems, one associated with and fixed to each sensor and the transmitter. Each axis system (henceforth referred to as a basis) is not in general aligned with any another. We define each basis (say basis S associated with a sensor S which is one of the sensors 5, 7, 14 ) by three unit vectors $$\{e_1^S, e_2^S, e_3^S\},$$

so that any vector Q may be expressed in the basis as $$Q=x_1^s e_1^s+x_2^s e_2^s+x_2^s e_2^s, \quad (1)$$

for a set of real values $$\{x_1^S, x_2^S, x_3^S\}.$$

Similarly, we define a "transmitter basis" with respect to the transmitter unit 19 using unit vectors $$\{e^T, e_2^T, e_3^T\}$$

Each basis S is stationary with respect to the corresponding position sensor, but moves relative to the transmitter basis as that sensor moves relative to the transmitter unit 19.

On sensing the magnetic field 21 the sensors 5, 7, 14 generate two pieces of information which collectively define the sensor rate.

(a) The offset of the origin of the basis S from the origin of the transmitter basis in 3D space is referred to as:

$$X^{ST} = \{X_1^S, X_2^S, X_3^S\} \quad (2)$$

This defines the sensor translational position.

(b) The rotation $M^{ST}$ of the sensor basis relative to the transmitter basis in 3D space is given by:

$$e^s=M^{ST}.e^T \quad (3)$$

Where $M^{ST}$ is a 3 by 3 matrix built from the three angles (i.e. three degrees of freedom) needed to describe a rotation. This defines the sensor orientation.

The output of all three sensors is their time dependant "state". Note that this is not actually the "state" (i.e. position and orientation) of the teeth surfaces or of the end of the toothbrush in the mouth, which are what we ultimately require.

The operation of the system shown in FIG. 1 has three phases:

(1) A registration phase, which takes the raw motion tracking data captured during registration and using (a) 3D polygon models created in advance of the upper and lower teeth and toothbrush and (b) data from which the position of the probe sensor is accurately registered, converts the raw data into positions (including orientations) of the actual teeth and toothbrush surfaces. Note that this phase does not employ tracking data from the actual toothbrushing.

(2) A capture phase, in which the toothbrushing is carried out and the output of the position sensors is captured.

(3) An analysis phase, which extracts information from the registered data characterising the time spent by the toothbrush head in differing regions of the mouth. This information can be displayed using several visualisation modes as appropriate (bar plots, iso-surfaces, spatial volume renderings, line and surface colouring).

During all the phases visualisation techniques are employed extensively using 3D polygonal models of the toothbrush and the upper and lower jaw, to direct the user through the registration process, produce virtual representations of the toothbrush/jaw motions and visually explore the recorded data.

All the components are integrated into a single application running on the computer 14, with a windows based intuitive subject interface. We will now discuss the phases in turn:

(1) The Registration Phase

The objective of the registration process is to determine the spatial relationship between the position and orientation of each sensor and the position and orientation of the surfaces of features they are intended to track. Recall that the sensors are attached as rigidly as possible to something that moves in the same way as the feature they are intended to track, but not necessarily directly to that feature.

In the case of the toothbrush, the sensor 12 is directly attached to the end of the toothbrush handle 3—but we would like to track the motion of the toothbrush head.

In the case of the upper jaw, the sensor 7 is attached to the bridge of the nose which is clearly rigidly attached to the upper jaw—but it is not the upper jaw.

In the case of the lower jaw where the sensor 5 is attached to the centre of the chin, similar comments to the upper jaw apply, with the acknowledgement that the sensor here will always be less well attached, since the skin is more flexible in this region.

What we require is to calculate the position and orientation of each real point on the toothbrush and jaw surface as they move (initially in the transmitter basis), given the state of the position sensors in the transmitter basis.

The registration process that we propose to solve this problem frees us from having to attach the sensors accurately in any particular place and in doing so makes it practical to make the desired measurements.

To achieve registration we employ two more features of the system of FIG. 1:

A calibrated registration probe

Realistic full size computer models of the upper and lower jaws of each subject being tested, and of the toothbrush.

Figure 2:
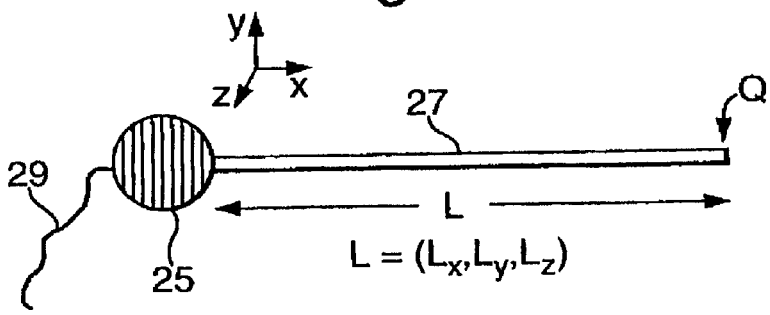
FIG. 2 shows the definition of a parameter employed in the analysis.

The registration probe is shown in FIG. 2, and consists of a fourth position sensor 25 attached to a thin rod 27 having an end point labelled Q. The sensor 25 and end Q have a vector offset L. Unlike the positioning of the other sensors 5, 7, 14 relative to the jaws and the head of the brush, the position and orientation of this sensor 25 relative to the end of the probe Q must be engineered or callibrated precisely. It is the only external registration used by the embodiment, so all the measurements made during the tooth brushing event depend upon the accuracy of the probe. The output of the sensor 25 is fed via lead 25 to the unit 13, and thence to the computer 14.

The offset L is measured from origin of probe sensor basis to the end of probe Q in a reference frame of the probe which is called the probe basis.

Using Eq (2) and (3), the position $Q^T$ of the probe endpoint Q in the transmitter basis can then be written as $$Q^T=M^{PT}.L+X^{PT} \quad (4)$$

where $M^{PT}$ is a rotation matrix encoding the relative orientation of the probe and transmitter bases. All the quantities on the right hand side are either output by the motion sensor, or known by construction.

The upper and lower jaw models of the subject under test are obtained at some time prior to the data capture. They are constructed by first making casts of each subject's teeth as in a normal dental procedure. These casts are then scanned using a laser scanning technique to capture accurately the surface shape in 3 Dimensions as a point cloud. A polygonal mesh is then constructed from the point cloud and so a full size polygonal model of the teeth cast is created.

The registration process is composed of two steps

Using the probe sensor we determine "registration points"—points on the real features of interest whose position and orientation is accurately known, both in the lab frame and in the frame of the sensor attached to the feature of interest.

Determination of the corresponding points on the appropriate 3D model of the object and hence calculation of the optimum transformation (rotation and translation) to bring one into the frame of the other.

We consider these steps below, when this registration complete it should be possible to accurately mimic the motion of the toothbrush and jaws, relatively and absolutely (i.e. relative to the transmitter basis).

We determine the registration points by touching the probe to the respective feature of interest. Depending on the method of registration we are using, either a small number (e.g. about four to six) of carefully chosen points must be identified and picked with the probe, or a larger number (e.g. over 200) of points are obtained by stroking the probe over the feature surface at random. In either case the best eventual registration will be obtained if the registration points are spread as evenly as possible over the feature of interest. The process is shown schematically in FIG. 3, in which a certain feature of interest is labelled a point N, and the end Q of the registration probe is shown in contact with point N.

Figure 3:
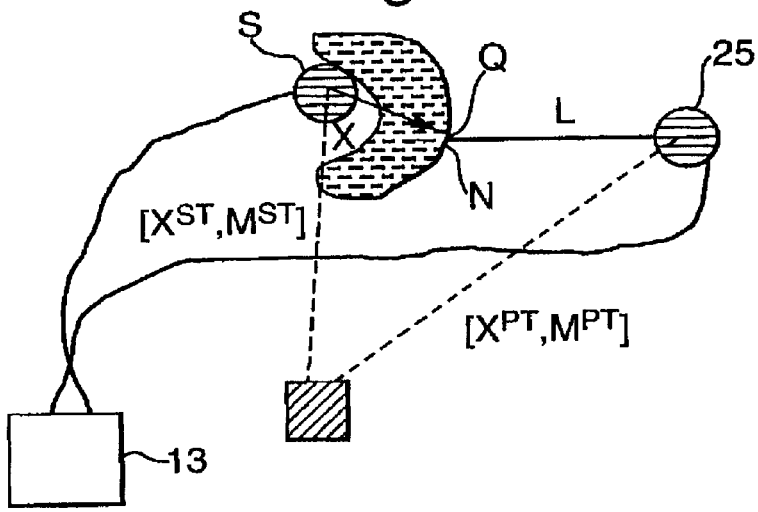
FIG. 3 shows the registration process according to an embodiment of the present invention.

The sensor marked as S in FIG. 3 may be either of the position sensors 5, 7, in fact whichever of those two sensors is associated with the point N (that is, is in fixed positional relationship with the point N). Since the end point Q of the probe is known in the transmitter frame from (4), the position of the registration point N must also be known in that frame at the point in time when they are coincident:

$$N^T = M^{PT} L + X^{PT} \tag{5}$$

Suppose we now consider the sensor S attached in fixed positional relationship to this feature N. Using (2,3) we can express any point with a position and orientation measured in the transmitter frame in that sensor's frame. So we can express the position of the registration point already known in the transmitter frame (5) in the frame of reference of the sensor attached to the feature:

$$x^S = \Delta^{ST}.[(M^{PT}.\ L + X^{PT}) - X^{ST}] \tag{6}$$

where $$\Delta^{ST} = (M^{ST})^{-1}$$

This expression gives the position/orientation of a point on the feature of interest, relative to the sensor rigidly attached to that feature, in the frame of that sensor. This quantity must therefore be time independent—independent of feature motion.

Note that it does not matter therefore that if feature being registered moves during the registration process—since in this case the motion will be tracked by the feature sensor and taken account of in (6) via the $\Delta^{ST}$ and $X^{ST}$ terms. Thus the registration is robust to movements of the subject—a key requirement in making the experiment as minimally invasive as possible.

The output of the step of the registration process is therefore a small set of points on the surface of each feature whose position is known accurately with respect to the feature sensor.

In general what we want to know is the position of every point on the surface of each feature, relative to the feature sensor. It is in practice sufficient to consider the positions of a mesh of points on the feature surface, the mesh being sufficiently fine to be representative of the feature shape at the resolution of interest.

In principle this mesh could be obtained by very finely stroking the probe over all of the teeth surface and following the procedure given above. However this would be extremely time consuming, uncomfortable for the subject and experimenter, and unlikely to produce a very regular mesh of points as mistakes would be very readily made.

The approach we take in this application is to use a set of realistic computer models of each of the features aligned appropriately with the feature sensor. If we could map the feature model onto each feature so that the orientation and position of the model in the feature sensor basis is exactly as for the feature itself, then the positions of the real features surface will be given by the position of the model mesh points (within the sensor basis). These are exactly the points we then require.

The computer models are generated by capturing the shape of the features of interest using a macroscopic capture technique such as laser scanning. The toothbrush is scanned directly. In order the capture the upper and lower jaws accurate plaster casts are made using standard dental techniques and these casts scanned. The output in each case is a point cloud—a mass of points, the envelope of which maps out the feature shape. This point cloud is then meshed to produce a set polygons, the vertices of which we take as the set of surface points sufficient to envelope the shape. For example the picture of a jaw model below.

Figure 4:
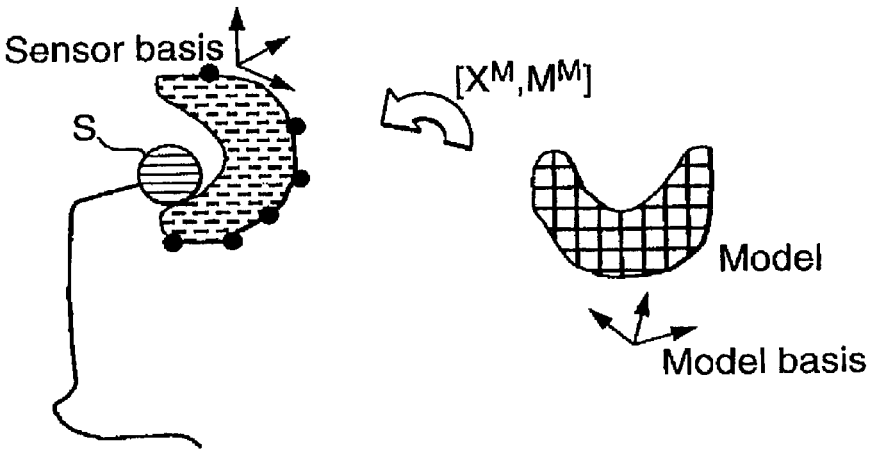
FIG. 4 shows the transformation T between the feature model basis and the feature sensor basis.

The co-ordinates describing the vertices are of course relative to yet another basis—that used in building the mesh (the model basis M). We therefore find the transformation T between the feature model basis and the feature sensor basis. This transformation can be written as $[X^{MF}, M^{MF}]$, and is shown in FIG. 4. Since all objects are considered rigid, this transformation consists of a set of translations $X^{MF}$ to make the axes origins coincident and then rotations $M^{MF}$ to align the co-ordinate axes.

Consider the registered points N found above. If the respective corresponding points on the model geometry could be found accurately then we could try and find the optimum rotation and translation that would transform one into the other. Providing the registration points are sufficiently representative then this should be the best estimate for $[X^{MF}, M^{MF}]$. Since the model and features are both rigid, applying this transformation to each point on the model should bring it into the required alignment.

The key issue is finding the model points which correspond to the already determined registration points. This is an example of a quite general problem in the robotics literature called surface or shape matching.

There are two basic approaches to this problem.

(1) Use the probe to pick a small number (e.g. 4 to 6) of registration points at specific positions N in fixed relationship to the sensor S (e.g. fixed points on the teeth). Pick the corresponding positions (by eye, using a visual display of the jaw model and computer mouse) on the computer model, thus determining the correspondences manually. We will call this the "known correspondence approach".

(2) Use the probe to pick a range of points sufficient to outline the feature, but make no attempt at determining the correspondences a—priori as in (1). We will call this the "unknown correspondence approach".

In either case the mathematical approaches to solve for the required transformations using the given information are discussed in the paper "Closed-form solution of absolute orientation using unit quanternions" by Berthold K. P Horn, J. Opt. Soc. Am. A, 4(4) April 1987, the disclosure of which is incorporated herein in its entirety by reference. We will outline the principles and application to this embodiment below.

(1) Solution for the Known Correspondences Approach

Essentially we want the transformation that matches up the dots. The first step in doing this is finding a criterion that characterises a "good" match.

To do this note that when the match is good the model and feature will (correctly) overlap and the distance between corresponding points should tend to zero. The closer the correspondence the smaller is this distance, but it is unlikely ever to be zero because measurements are only ever made to a certain precision. This leads us to characterise the registration using a minimum distance criterion ($d_{mes}$) equal to the square root of the mean square distance between the two sets of points. Assuming there are $N_r$ registration points, the I-th registration point being given by a vector $R^r_i$ and the corresponding model point $R^m_i$, then $d_{mes}$ is given by $$dmes = \sqrt{\frac{1}{N_r}\left(\sum_{i=0}^{N_r-1} |\vec{R}_i^r - \vec{R}_i^c|^2\right)} \tag{7}$$

Where $|\vec{R}_i^r - \vec{R}_i^c|$ is the absolute value of the difference between the enclosed vectors. The value of $d_{mes}$ tends to zero as the model and reality coincide and in practice we consider the registration to be successful when $d_{mes}$ is less than a chosen tolerance value.

Perhaps the simplest way to use this criterion is by systemically searching through all possible combinations of $[X^{MF}, M^{MF}]$ in a quantized space, evaluating the distance measure each time, eventually accepting the transformation that has minimum distance measure as the required solution. $M^{MF}$ is a 3×3 matrix having only three degrees of freedom, so the search for the best $M^{MF}$ is just a search in a three dimensional space. Generally we have found that it is best to optimise $X^{MF}$ before $M^{MF}$. This is the brute force approach, and even with careful ordering of the test transformations it can take many iterations and is not certain to find the best solution.

Fortunately this iterative approach is not required since as described in the article by Horn et al referred to above, for this situation there exists a closed form solution which gives explicitly the optimum transformation which minimises the distance measure.

Figure 5:
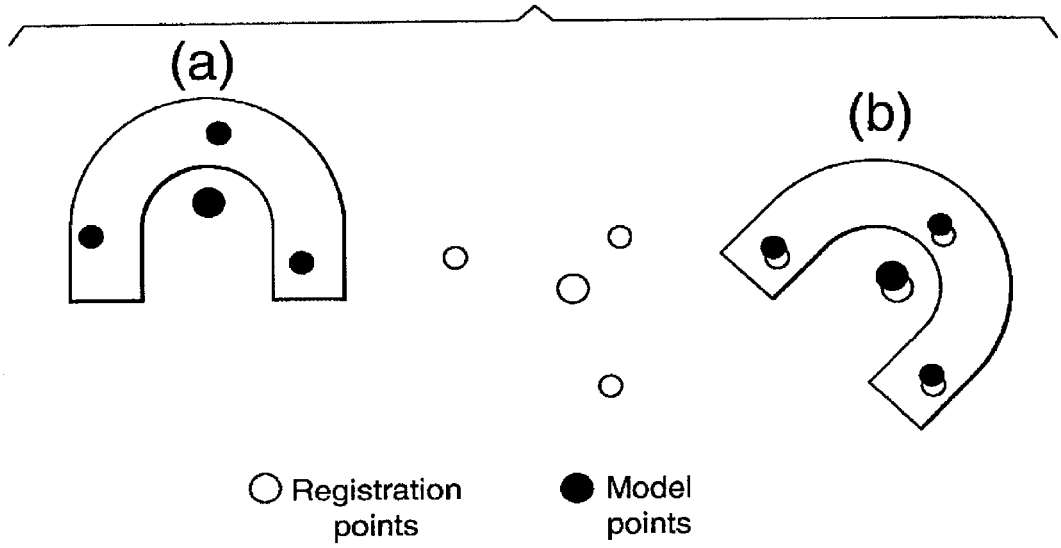
FIG. 5, which is composed of FIGS. 5(*a*) and 5(*b*), shows a registration process for matching known points on a set of teeth with the corresponding set of model teeth points.

Despite the fact that only the minimum number of registration/corresponding points are used and the obvious error in having to visually match the points on the model and the feature, with some practice some good registrations can be achieved. This is shown in FIGS. 5(*a*) and (*b*).

While this method is much faster and more comfortable than using the probe to capture the whole mesh, it remains quite time consuming to find the corresponding points by eye. In normal operation it may be the inexperienced subject and not the experimenter who has to determine the correspondence using the probe, further complicating the process. All these factors contributes to the overall error in using the embodiment.

(2) Solution for the Unknown Correspondences Approach

In the unknown correspondence approach we propose an iterative closest point algorithm derived from Horn et al discussed above. To combat the errors introduced known correspondence approach, the closed form solution can be extended into an iterative one incorporating a search for the model points, corresponding to registration points. This avoids the need to pick the corresponding points by eye with associated inaccuracy. The steps of the iterative method are as follows:

(a) Stroke the probe sensor across the teeth to collect a set of registration points (a number $N_r$+1). Sufficient points must be collected so that there is a reasonable sampling of the feature geometry but certainly no fine mesh of points is required (e.g. 200 points spread over the feature extents are usually sufficient). We then perform some basic co-ordinate transformation such that model and registration points are both in their Centre of Mass representation.

(b) For each registration point (i) use as the first guess of the corresponding model point, that model point which is simply closest to the registration point. The distance from a registration point I, and the model point j being given by $$d_{ij} = |R_i^r - R_i^M| \quad \text{for} \quad j = 0, 1, \ldots N_r + 1. \tag{8}$$

(c) We select the value of j that minimises $d_{ij}$, to be the index of the required model point. This guess will almost certainly not result in the real set of corresponding points—it just serves to drive the iterative process.

(d) Compute the optimum transformation for this correspondence as in the known correspondence approach, and apply that transform to the registration points.

(e) Compute the distance measure (7) after this transformation. If it this calculated to be more than a required value, or has changed by more than a given value since the previous iteration, then perform steps (b) to (e) again for the new location of the transformation points.

(f) If the distance measure is satisfactory then the accumulated transformation is the required transformation.

Figure 6:
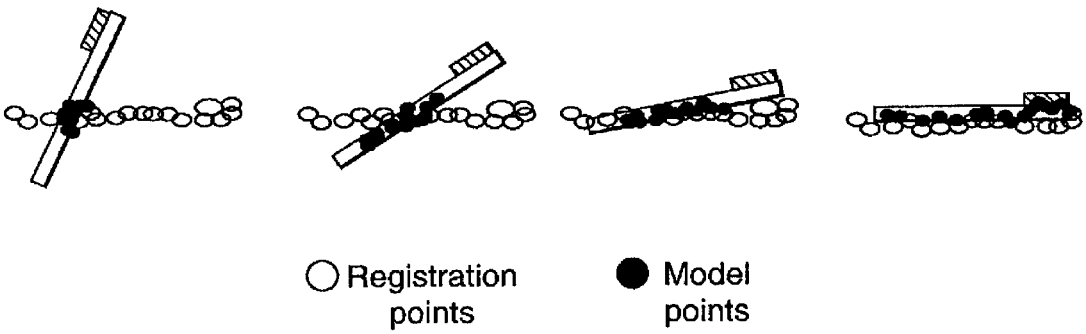
FIG. 6, which shows four images of a registration process for matching a large set of unknown points on a real toothbrush with the corresponding set of model toothbrush points.

Providing the selected registration points are a reasonable measure of the shape to be matched then this can be a successful strategy, with the shape matched in a small number of iterations. Results of this are shown in FIG. 6.

Note that in the preferred embodiment, an operator of the system is able to select which of the known correspondence approach and the unknown correspondence approach is used. The output of the registration process is a set of models accurately aligned with the feature sensors, so as to mimic the motions and surface positions of the real features.

Note that the present invention is not limited to a registration process as described above. Actually, both of the methods described can be enhanced within the scope of the invention as will be clear to a skilled person, by techniques such as pre-processing, to make them more robust or faster. In particular, for the unknown correspondences case we have found that fine adjustment of the initial conditions helps to ensure that the iterative processes does converge to the true global minimum.

Furthermore, an alternative technique within the scope of the invention is to replace the geometrical representation of the real subject's teeth, with a geometry of a generic set of teeth which we deform "to fit" using the probe sensor data. This enables us for many applications to omit the collection of individual teeth geometries which is the most time consuming and expensive part of the process described above.

The description above shows how the probe can be used to obtain the relationship of the teeth and position sensors in relation to any given frame, e.g. the transmitter frame. A similar process is carried to identify the position of the toothbrush in this frame. To obtain input data which corresponds to the scanned teeth model, the toothbrush can be scanned in a similar way, or alternatively the 3D model can be obtained from computer aided design data. The position and orientation of the position sensor 12 mounted on the toothbrush 3 can then be found in the probe basis by touching the tip Q onto the toothbrush carrying the position sensor 12 when the two are in a known relative orientation. After this, the output of the position sensor 12 and the sensor 25 are enough to track the movements of the toothbrush (e.g. the head of the toothbrush) in the transmitter frame, by a transformation similar to that described above with relation to FIG. 2.

2. The Capture Phase

In this phase the act of toothbrushing (the "toothbrushing event") is captured. The subject is encouraged to brush their teeth in as natural a manner as possible, they are not required to keep their head still. The resolution of capture is driven by the output rate of the position sensors.

During this process all the in use position sensors must remain in the same position relative to the objects they are tracking and this must be the same position used in calculating the registration.

If the graphics performance of the controlling computer is sufficient, then it may be possible to visualise and analyse the tooth-brushing event, either for the observer or subject, as it happens. This would allow for a number of variations on the basic event capture, for example it would be possible to visually direct the subject to brush a part of their teeth which was not well visited up to then in the brushing process.

All the position sensor data (together with all the registration data) is saved to disk for subsequent exploration and analysis.

3. The Analysis Phase

The motion data is used to make a calculation of the time spent by the toothbrush head in differing regions of the Oral Cavity. To do this (a) Using the parameters discovered during the registration phase, the whole toothbrush motion sequence (for a representative point on the toothbrush head) is separately and independently transformed to the basis of the upper jaw and lower jaw.

(b) For each point in the motion sequence, the closest upper and lower jaw point to the brush side of the toothbrush head is separately determined. A comparison between these two sets of distances is made, and used to determine to which jaw the toothbrush is pointing at each recorded time step.

(c) The data for each jaw is now treated separately. A geometric template, pre-generated using some other software and loaded separately from a file, is used to divide the "space" of the jaw into regions. The motion signal is then tracked through the jaw space, and for each step the region it belongs to noted, and the portion of time taken by that step accumulated with care taken to deal properly with the situation where the motion step crosses a region boundary. The template may be two- or three-dimensional; for most applications, adequate accuracy is generally achieved by a two-dimensional template. The point on the toothbrush chosen to represent the toothbrush motion is determined by the nature of the toothbrushing experiment. Any point represented in the polygonal model of the toothbrush is available, and can be analysed in this way.

Figure 7:
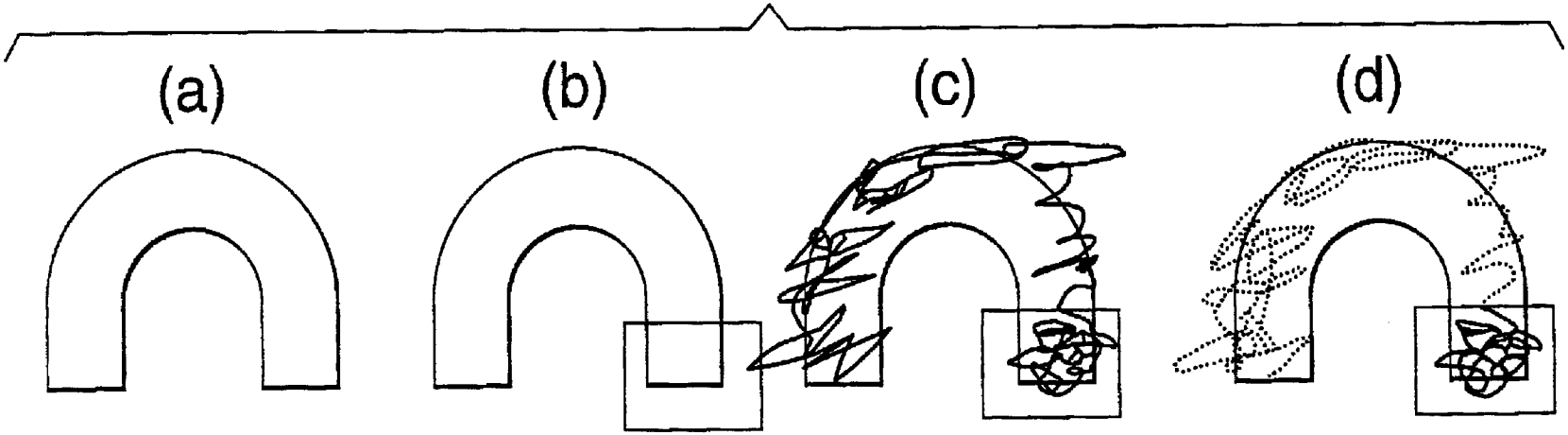
FIG. 7, which is composed of FIGS. 7(*a*) to (*d*), shows four images obtained using a position of the track of a toothbrush over a set of teeth.

The output is the amount of time spent in each region, as shown in FIG. 7.

This is done separately for each jaw, using in each case only the appropriate part of the motion signal.

The geometric template can be:

built automatically using data on the individual teeth geometries and jaw extents already loaded into the embodiment, generated using some other software and loaded separately, or drawn interactively using the mouse.

(c) This data is then presented as a bar chart, showing the percentage of the total time spent in each region and absolute time spent in each region, for each subject.

(d) The analysis output are then stored in a file associated with the corresponding capture and registration data. The data is preferably in a format which would allow it to be combined with a conventional dental record for the subject.

A preferred feature of the analysis phase is that it includes calculating and visualisation of the orientation of the toothbrush head (e.g. by indicating the unbent bristle length direction) for each point in the toothbrush motion capture.

An important feature of the embodiment is the use of visualisation components to guide the user through the experimental process and to explore the resulting data. To make use of the data from the position sensor mounted on the toothbrush, it is important to be able to visualise what is going on at all stages of the process as we are aiming to understand the motion of the toothbrush, relative to the jaw and teeth surfaces within the oral cavity. Therefore being able to see and interact with data in context is important. Accordingly, the invention proposes novel visualisation techniques applied at the following times:

During registration: to give a visual check on the accuracy of the registration process, to aid the process of picking corresponding points and to keep track of the stage at which the process is at.

During Motion Capture: Optionally, a visualisation of the toothbrushing process can be produced by animating the 3D models with the motion tracking data as it is collected. The requirement to spend some computer time updating the visual display has a penalty in that it somewhat reduces the maximum capture rate possible. Visualisations like these could be used to interdict the toothbrushing process, for example a particular tooth could be coloured differently from the rest and the instruction given to the subject to "brush away the colour".

Post Processing visualisations:

The motion tracking data is saved to disk and can be used, together with the feature models to generate offline animations of the toothbrush event. Animations can be created in the transmitter basis, or any of the position sensor bases. For example it is useful (and for the subsequent analysis essential) to be able to visualise the data in each jaw sensor basis—this is the basis in which the jaw is stationary making it easy to calculate the minimum distance being any given point on the toothbrush from the jaw. In the analysis component several visualisations are used (in the basis in which the jaw is stationary) to illustrate to which regions differing parts of the toothbrush motion belong to, how far each part of the jaw is from the toothbrush etc.

To perform these visualisations we make use of World toolkit, an real-time/virtual reality software library (commercial). This has the performance required for the interactive visualisation, together with built in components that automatically poll the motion sensors.

Although adequate visualisation may be achieved as described above using a conventional two-dimensional screen display, improved visualisation may be achieved by making use of virtual reality (VR) techniques. Specifically, such techniques allow us to:

(1) Create much more realistic visual displays (e.g. stereo view, immersive displays etc). This gives the subject a much better idea of the spatial relationships involved.

(2) Use the interactive graphics performance to create novel sorts of toothbrushing experiments which just are not possible with traditional scenarios.

The following is a brief description of how the embodiment is used in a real dental trial to for example determine if a particular toothbrush is more effective at reaching differing parts of the mouth.

(1) Some time before the trial, computer models of the each subject's upper and lower jaw and the toothbrushes being used are obtained and the statistical design of the trial agreed. Any required legal documentation for the trial is completed.

(2) When a given subject's turn arrives:

(a) The sensors are attached to the in the upper and lower jaw locations and at the end of that subject's toothbrush (end furthest from brush head).

(b) the registration procedure is used to align geometries with position sensors, using the probe sensor. For each subject that part of the probe sensor that enters the mouth must either be sterilised or the probe made in such a way that that part is replaceable for each subject.

(c) The subject is then asked to brush their teeth in the normal way, depending on the situation the subject may or may not be shown the real-time feedback of their tooth brushing. All captured data is saved to disk.

(d) At end of toothbrushing event the sensors are detached and subject leaves.

(e) This process is repeated for each subject.

(f) All the data is then brought together and analysis made, and if required any of the other post collection visualisations.

Although the invention has been described above in relation to a single embodiment, many variations are possible within the scope of the invention as will be clear to a skilled person. For example, the invention may be applied both to a toothbrush which is a manual toothbrush and to a toothbrush which is an electric toothbrush.

It is even possible to use the present invention in contexts other than the tracking of a toothbrush, to monitor the position of any item of equipment in relation to the human body. For example, the invention could be applied to tracking of an electric shaver device in relation to the skin of a subject who shaves.

What is claimed is:

1. A method of monitoring the position of a toothbrush relative to teeth of a subject, the method comprising:

providing a toothbrush having a first position sensor, the first position sensor at least being sensitive to changes in position and orientation;

providing a second position sensor in fixed positional relationship to the teeth, the second position sensor being sensitive to changes in position and orientation;

transmitting the output of the first position sensor and second position sensor to a processing apparatus;

comparing via the processing apparatus the two sensor outputs to monitor the position of the toothbrush relative to the teeth over a period of time;

locating a third position sensor in turn in a known positional relationship to the second position sensor and at least four locations on or in fixed relationship to the teeth, and comparing the locations to corresponding positions of a computer model to derive a transformation between a reference frame of the computer model and a reference frame of the second position sensor.

2. A method according to claim 1 in which a correspondence between the locations and respective locations in the computer model is known.

3. A method according to claim 1 further including deriving a correspondence between the locations and respective locations in the computer model.

4. A method according to claim 1 further including visually displaying the position of the toothbrush with respect to the subject's oral geometry.

5. A method according to claim 4 in which the position of the toothbrush with respect to the oral geometry is displayed in real time during a brushing process.

6. A method according to claim 4 in which the subject's oral geometry is obtained by computationally deforming a generic computer model of an oral geometry according to measured distance parameters of the subject's mouth.

7. A method according to claim 1 including displaying visually to the subject during the brushing process a record of an earlier trajectory of the toothbrush with respect to the user's oral geometry.

8. A method according to claim 1 further including statistically analysing the monitored position of the toothbrush in relation to the teeth to investigate toothbrush usage.

9. A method according to claim 1 in which the toothbrush further comprises at least one physical sensor which is a pressure sensor or a pH sensor.

10. A method according to claim 1 in which the toothbrush includes wireless data transmission means, and the processing apparatus includes corresponding data reception means.

11. A method according to claim 1 in which at least one of the position sensors is a self-powering device.

12. A method according to claim 1 comprising identifying potential usage improvements based on comparison of the position of the toothbrush relative to the teeth over a period of time, and indicating those improvements to the subject undergoing training to improve their toothbrush usage.

13. A system for monitoring the position of a toothbrush relative to teeth of a subject, the system comprising:

a toothbrush having a first position sensor, the first position sensor at least being sensitive to changes in position and orientation;

a second position sensor for attachment in fixed positional relationship to the teeth, the second position sensor being sensitive to changes in position and orientation;

a third position sensor located in a known positional relationship to the second position sensor and at least four locations on or in fixed relationship to the teeth; and data processing apparatus arranged to receive the output of the first position sensor, second position sensor and third position sensor, and to compare the sensor outputs to monitor the position of the toothbrush relative to the teeth over a period of time.

* * * * *